US005524835A

United States Patent [19]

Collins

[11] Patent Number: 5,524,835

[45] Date of Patent: Jun. 11, 1996

[54] TISSUE DISPENSER INCLUDING LOW FRICTION MANDREL

[75] Inventor: Scott J. Collins, Milwaukee, Wis.

[73] Assignee: Fort Howard Corporation, Green Bay, Wis.

[21] Appl. No.: 213,985

[22] Filed: Mar. 16, 1994

[51] Int. Cl.[6] ..... B65H 67/00

[52] U.S. Cl. ..... 242/560; 242/597.6; 242/613.1

[58] Field of Search ..... 242/597.6, 597.5, 242/597, 613.1, 612, 594.5, 590, 560, 596.7, 599.2, 599.4

[56] References Cited

U.S. PATENT DOCUMENTS

| | | | |
|---|---|---|---|
| D. 265,700 | 8/1982 | Breger et al. | D6/95 |
| D. 312,739 | 12/1990 | Sigmund | D6/523 |
| 2,571,321 | 10/1951 | Wettley | 242/599.4 |
| 3,079,099 | 2/1963 | Blain . | |
| 3,482,796 | 12/1969 | Tucker | 242/597.5 |
| 3,593,936 | 7/1971 | Davis . | |
| 3,917,185 | 11/1975 | Canada et al. . | |
| 4,088,276 | 5/1978 | Littleton . | |
| 4,205,802 | 6/1980 | Economakis | 242/594.5 |
| 4,422,584 | 12/1983 | Dashnier et al. | 242/597.5 |
| 4,796,832 | 1/1989 | Schutz et al. | 242/594.5 |
| 5,125,586 | 6/1992 | Whitehorn | 242/597.6 |

FOREIGN PATENT DOCUMENTS

| | | | |
|---|---|---|---|
| 613556 | 8/1991 | Australia | 225/77 |
| 1072504 | 2/1980 | Canada | 242/599.4 |
| 671858 | 12/1929 | France . | |
| 2645184 | 4/1978 | Germany . | |
| 0920422 | 3/1963 | United Kingdom | 242/596.7 |

*Primary Examiner*—Daniel P. Stodola
*Assistant Examiner*—William A. Rivera
*Attorney, Agent, or Firm*—Michael, Best & Friedrich

[57] ABSTRACT

A dispenser for a roll of tissue material wound around a tubular roll core having an inner surface, the dispenser comprising a housing including a base; and a mandrel mounted on the base for supporting the roll for rotation about a generally horizontally extending axis, the mandrel including an outer surface and structure for reducing frictional engagement between the roll core inner surface and the mandrel outer surface.

8 Claims, 2 Drawing Sheets

TISSUE DISPENSER INCLUDING LOW FRICTION MANDREL

BACKGROUND OF THE INVENTION

1. Field of the Invention

The invention relates to dispensers for rolls of toilet tissue and similar material.

2. Reference to Prior Art

Rolls of toilet tissue and similar sheet material typically include an elongated strip of tissue material wrapped around a hollow, cylindrical roll core. Dispensers for rolls of tissue typically include a housing formed by a base and a cover which cooperates with the base to define a compartment for containing a single roll of tissue. A mandrel is mounted on the base for supporting the roll for rotation about a horizontally extending axis. The mandrel is a cylindrical member having a continuous outer surface, and the roll core is supported on the outer surface. The mandrel also has an inner end portion connected to the base, and a cantilevered terminal end portion opposite the inner end portion. Typically, the mandrel is tapered from the inner end portion to the terminal end portion such that the terminal end portion is smaller in diameter than the inner end portion.

To prevent users from encountering an empty roll core, one type of dispenser includes primary and stub mandrels for dispensing primary and stub rolls of tissue. The primary roll is new when installed on the primary mandrel, and the stub roll is a partially used primary roll transferred from the primary mandrel when installing a new primary roll. Both the primary and stub mandrels are constructed as described above.

SUMMARY OF THE INVENTION

The invention provides a dispenser wherein a roll of tissue is supported on a primary mandrel such that frictional engagement between the roll core and mandrel is reduced, and the tissue does not tear prematurely when pulled from the roll.

The invention also provides a dispenser of the type described above wherein rotation of the roll can be initiated with relatively little effort by pulling tissue from the roll.

The invention also provides a dispenser of the type described above wherein the roll will not slide off the end of the mandrel.

More particularly, the invention provides a dispenser including a housing having a base and a cover cooperating with the base to define a compartment for containing a roll of tissue. The tissue roll includes tissue material wrapped around a tubular roll core. A mandrel is mounted on the base for supporting the roll of tissue for rotation about a horizontally extending axis. Preferably, the dispenser includes primary and stub mandrels for supporting respective primary and stub rolls of tissue. The primary mandrel is a cylindrical member including a longitudinal axis, an outer surface, opposed inner and terminal end portions, and means for reducing frictional engagement between the roll core inner surface and the mandrel outer surface. Preferably, the friction reducing means includes a plurality of longitudinally spaced, fin-shaped first projections extending upwardly from the outer surface of the mandrel and having upper edge portions for contacting the roll core inner surface and thereby supporting the roll core away from the outer surface of the mandrel. Preferably, the mandrel also includes retaining means for preventing longitudinal movement of the roll beyond the terminal end portion in a direction away from the base. This retaining means includes a projection extending upwardly from the outer surface at the terminal end portion and having an upper edge portion generally above the upper edge portions of the first projections.

Other features and advantages of the invention will become apparent to those skilled in the art upon review of the following detailed description, claims and drawings.

BRIEF DISCUSSION OF THE DRAWINGS

Figure 1:
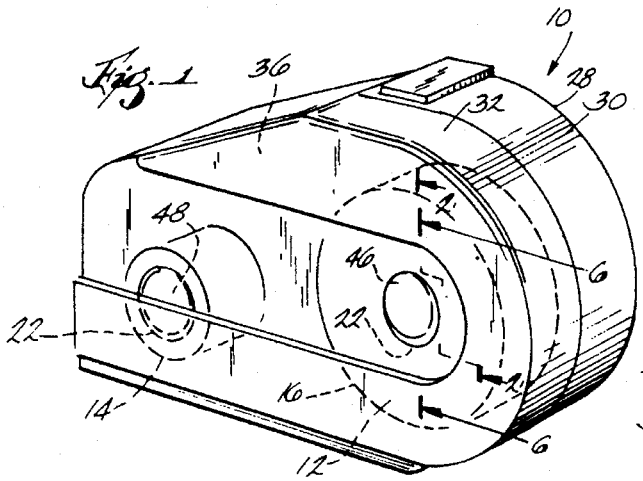
FIG. 1 is a perspective view of a tissue dispenser for primary and stub rolls, showing the cover in the closed position.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF A PREFERRED EMBODIMENT

Illustrated in the drawings is a dispenser 10 (FIG. 1) for dispensing primary and stub rolls 12 and 14 of tissue material 16. In alternative embodiments of the invention, the dispenser could be constructed to hold only a primary roll of tissue. Each of the rolls 12 and 14 includes an elongated strip of tissue material 16 wound around a roll core 18. Each roll 12 and 14 has a respective outside diameter defined by the outside diameter of the tissue material 16. The outside diameter of the stub roll 14 is less than the outside diameter of a new primary roll 12 because, as described in detail below, the stub roll 14 is a partially used primary roll 12. As best shown in FIG. 2, the roll core 18 is a tubular member including a wall 22 having an outer surface 24 around which the tissue material 16 is wrapped, and an inner surface 26 opposite the outer surface 24.

Figure 3:
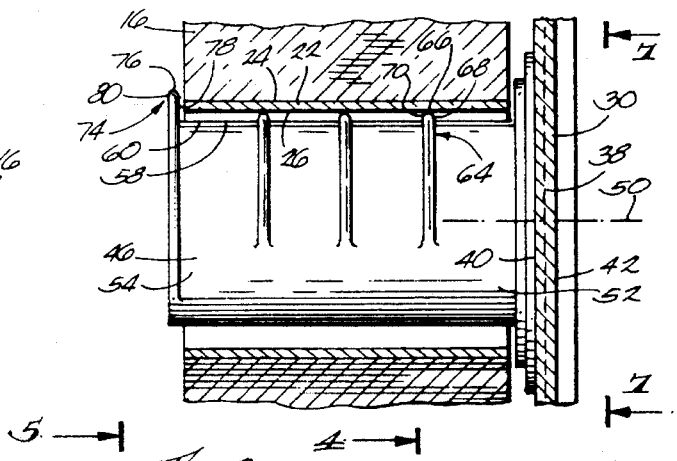
FIG. 3 is an enlarged, partial sectional side view of the mandrel shown in FIG. 2.
Figure 6:
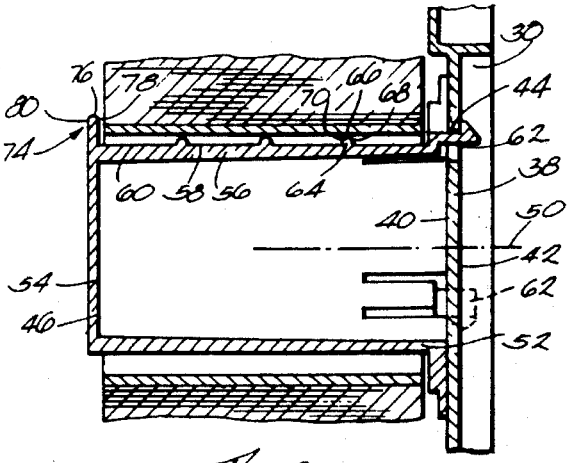
FIG. 6 is an enlarged, cross-sectional view taken generally along line 6—6 in FIG. 1.
Figure 7:
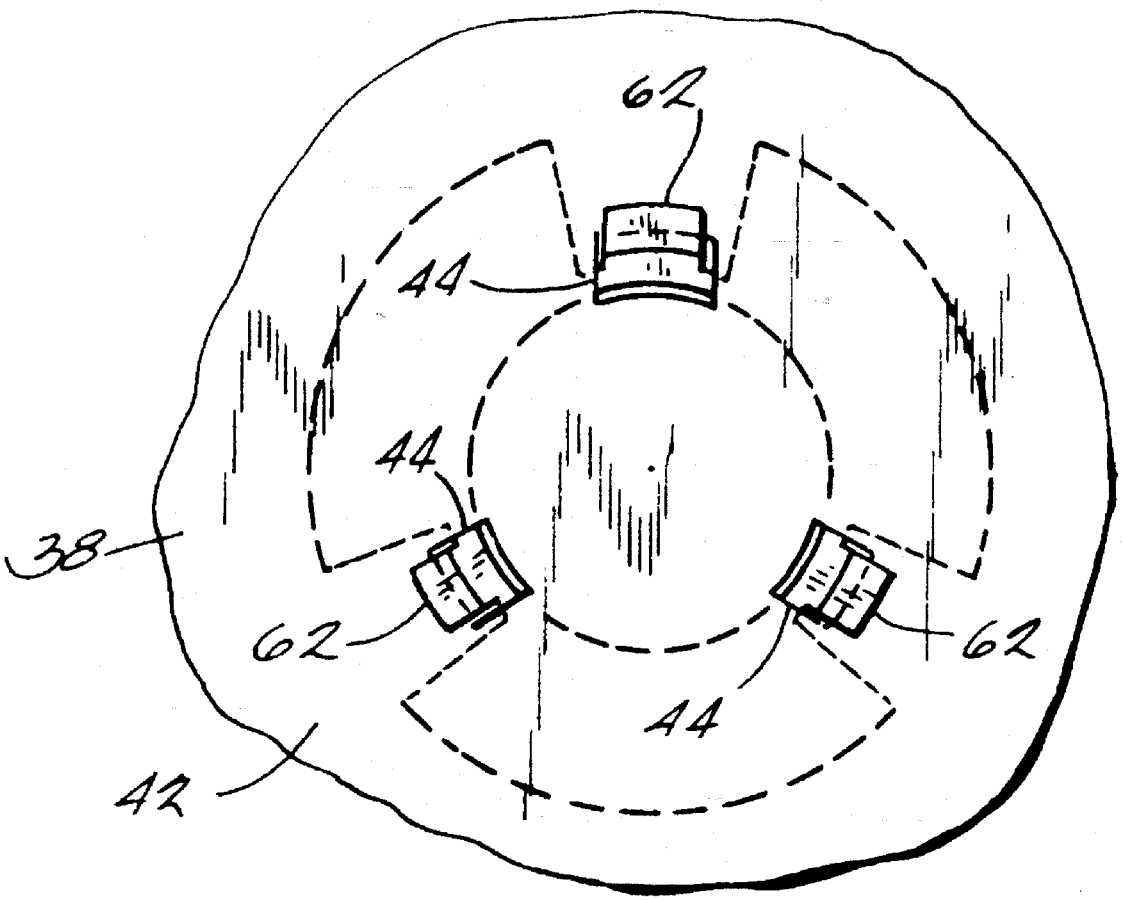
FIG. 7 is a partial rear view taken generally along line 7—7 in FIG. 3.

The dispenser 10 includes a housing 28. The housing 28 includes a base 30 and a cover 32 mounted on the base 30 for pivotal movement about a horizontal axis between an open position (not shown) and a closed position shown in FIG. 1, wherein the base 30 and cover 32 cooperate to define a compartment 36 for containing the rolls 12 and 14. As best shown in FIGS. 3 and 6, the base 30 includes a back wall 38 having opposed inner and outer surfaces 40 and 42. As best shown in FIG. 7, three spaced apertures 44 extend through the back wall 38 between the inner and outer surfaces 40 and 42. The apertures 44 are arranged in a generally circular pattern as further described below.

Figure 2:
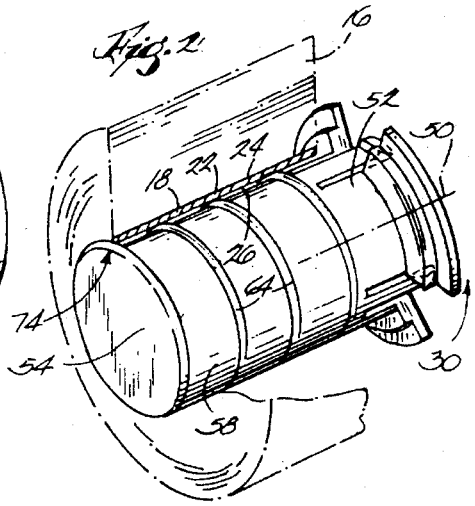
FIG. 2 is an enlarged, partial sectional view taken generally along line 2—2 in FIG. 1, showing the primary mandrel mounted on the base.

Referring to FIG. 1, the dispenser 10 also includes primary and stub mandrels 46 and 48. The mandrels 46 and 48 are mounted on the base 30 for supporting the respective primary and stub rolls 12 and 14 in the compartment 36 for rotation about respective horizontally extending axes. The stub mandrel 48 is of conventional design and will not be described in further detail. Referring to FIGS. 2, 3 and 6, the primary mandrel 46 is a cylindrical member having a longitudinal axis 50, an inner end portion 52 connected to the base 30 and a terminal end portion 54 opposite the inner end portion 52. The primary mandrel 46 also includes an outer wall 56 having a generally cylindrical outer surface 58. The outer surface 58 includes an uppermost portion 60. As best shown in FIGS. 2, 6 and 7, three fingers 62 extend longitudinally from the outer wall 56 at the inner end portion 52. Each finger 62 engages one of the apertures 44 in the back wall 38 of the base 30, thereby connecting the primary mandrel 46 to the back wall 38. In other alternative embodiments of the invention, the primary mandrel 46 can be integrally formed with the back wall 38 or fixed to the back wall 38 by other suitable connecting means.

Figure 4:
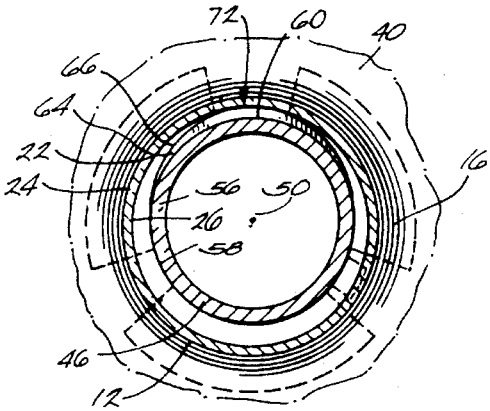
FIG. 4 is a sectional view taken generally along line 4—4 in FIG. 3.
Figure 5:
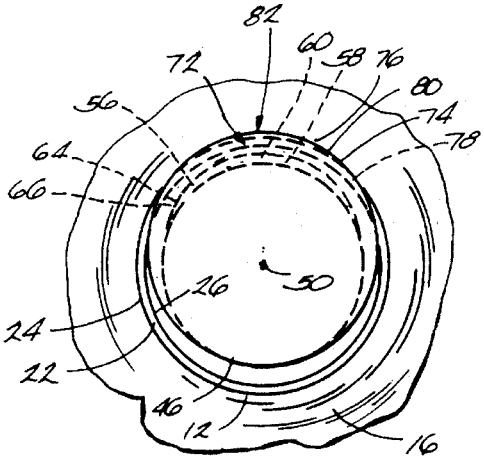
FIG. 5 is an end view taken generally along line 5—5 in FIG. 3.

The primary mandrel 46 includes means 64 for reducing frictional engagement between the roll core inner surface 26 and the mandrel outer surface 58. In the illustrated embodiment of the invention, the friction reducing means 64 includes three longitudinally spaced, parallel, fin-shaped first projections or ribs extending upwardly from the mandrel outer surface 58. As best shown in FIGS. 2, 3 and 6, each of the first projections 64 includes a narrow upper edge portion 66, and a pair of opposed sides 68 and 70 extending radially inwardly from the upper edge portion 66 toward the mandrel outer surface 58. As best shown in FIGS. 4 and 5, the upper edge portion 66 generally defines an arc having an apex 72 spaced vertically above the uppermost portion 60 of the mandrel wall outer surface 58. On both sides of the apex 72, the upper edge portion 66 curves downwardly and radially inwardly toward the outer surface 58, so that the first projection 64 tapers into the outer wall 56. The inner surface 26 of the roll core 18 rests upon the upper edge portions 66, so that the roll core inner surface 26 is supported away from the mandrel outer surface 58. Only a small portion of the roll core inner surface 26 contacts the upper edge portions 66 of the first projections 64, and the roll core inner surface 26 does not contact the uppermost portion 60 of the outer surface 58. The roll core 18 is thereby supported such that frictional engagement between the roll core inner surface 26 and the mandrel outer surface 58 is reduced. Therefore, the tissue material 16 does not prematurely tear when pulled from the primary roll 12, and rotation of the primary roll 12 can be initiated with relatively little effort by pulling the tissue material 16.

The primary mandrel 46 also includes retaining means 74 for preventing movement of the primary roll 12 along the mandrel longitudinal axis 50 beyond the terminal end portion 54 in the direction away from the base 30. In the illustrated embodiment of the invention, the retaining means 74 is a fin-shaped projection or rib extending upwardly from the mandrel outer surface 58 at the terminal end portion 54. In an alternative embodiment of the invention, the projection 74 can have other configurations. The projection 74 includes a narrow upper edge portion 76 and opposed inner and outer sides 78 and 80 extending radially inwardly from the upper edge portion 76 toward the mandrel outer surface 58. As best shown in FIG. 5, the upper edge portion 76 generally defines an arc having an apex 82 spaced vertically above the uppermost portion 60 of the mandrel outer surface 58 and the apexes 72 of the respective first projections 66. On both sides of the apex 82, the upper edge portion 76 curves downwardly and radially inwardly toward the outer surface 58, so that the projection 74 tapers toward the outer wall 56. At the apex 82, the upper edge portion 76 is higher than the upper edge portions 66 of the first projections 64, so that the primary roll 12 is engaged by the inner side 78 to prevent outward sliding movement of the roll 12 beyond the terminal end portion 54. In this manner, the roll 12 cannot slide off the terminal end portion 54 of the mandrel 46.

What is claimed is:

1. A dispenser for a roll of tissue material wound around a tubular roll core having an inner surface, said dispenser comprising:

a housing including a base; and a mandrel non-rotatably mounted on said base for supporting the roll for rotation about a generally horizontally extending axis, said mandrel including an outer surface received in the roll core and means for reducing frictional engagement between the roll core inner surface and said mandrel outer surface, said friction reducing means including at least one projection extending upwardly from said outer surface, wherein said mandrel outer surface plus said projection define a height which is less than the diameter of the roll core inner surface such that the roll core is adapted to be loosely supported by said projection.

2. The dispenser as set forth in claim 1 and wherein said friction reducing means includes a plurality of said projections spaced longitudinally along said mandrel.

3. The dispenser as set forth in claim 2 and wherein each of said projections includes an upper edge for contacting and supporting the roll core inner surface.

4. The dispenser as set forth in claim 1 and wherein said mandrel further includes a longitudinal axis, an inner end portion connected to said base, a terminal end portion opposite said inner end portion and means for preventing longitudinal movement of the roll beyond said terminal end portion in a direction away from said base.

5. The dispenser according to claim 4 and wherein said means for preventing longitudinal movement of the roll beyond said terminal end portion is a projection extending upwardly from said outer surface and above said friction reducing means at said terminal end portion.

6. The dispenser according to claim 1 and wherein said inner end portion of said mandrel includes a plurality of longitudinally extending fingers connecting said mandrel to said base.

7. A dispenser for a primary roll of tissue material and a stub roll of tissue material, each roll of tissue material including tissue material wound around a tubular roll core having an inner surface, said dispenser comprising:

a housing including a base;

a stub mandrel non-rotatably mounted on said base for supporting the stub roll for rotation about a generally horizontally extending first axis; and a primary mandrel mounted on said base for supporting the primary roll of tissue material for rotation about a generally horizontally extending second axis, said mandrel including an inner end portion connected to said base, a terminal end portion opposite said inner end portion, an outer surface, a plurality of longitudinally spaced apart first projections extending upwardly from said outer surface for contacting the roll core inner surface wherein said outer surface plus said first projections define a height which is less than the diameter of the roll core inner surface such that the roll core is adapted to be loosely supported by said first projections, and a second projection extending upwardly from said outer surface at said terminal end portion and having a portion above said first projections for preventing longitudinal movement of the primary roll in a direction away from said base.

8. The dispenser according to claim 7 and wherein said inner end portion of said primary mandrel includes a plurality of longitudinally extending fingers connecting said primary mandrel to said base.

* * * * *